US005897409A

United States Patent [19]

Hartman et al.

[11] Patent Number: 5,897,409

[45] Date of Patent: Apr. 27, 1999

[54] FLOATABLE LOUNGER WITH ROTATING HEADREST

[75] Inventors: Hermann David Hartman, Tottenham; Steven David Hartman, Erin, both of Canada

[73] Assignee: Industrial Thermo Polymers Limited, Brampton, Canada

[21] Appl. No.: 09/031,045

[22] Filed: Feb. 26, 1998

[51] Int. Cl.[6] ..... B63B 35/86

[52] U.S. Cl. ..... 441/129

[58] Field of Search ..... 441/47, 129–132, 441/125, 126, 136, 44–46; 472/128, 129

[56] References Cited

U.S. PATENT DOCUMENTS

| | | | |
|---|---|---|---|
| 4,824,411 | 4/1989 | McClanahan | 441/129 |
| 5,772,484 | 6/1998 | Sikorski | 441/81 |

*Primary Examiner*—Ed L. Swinehart
*Attorney, Agent, or Firm*—Eugene J. A. Gierczak

[57] ABSTRACT

A floatable lounger includes a first buoyancy means; second buoyancy means spaced from said first buoyancy means; first and second extending means; and headrest rotatable about said first extending means between a first stored position and a second operable position. The floatable lounger provides for a simpler construction for a floating lounger with excellent buoyancy.

20 Claims, 6 Drawing Sheets

FLOATABLE LOUNGER WITH ROTATING HEADREST

DESCRIPTION

1. Field of Invention

This invention relates generally to floatable device, and more particularly to a floatable lounger for supporting a swimmer on a water surface in a reclined position.

2. Background Art

Floatable devices and namely floatable loungers on which a swimmer can comfortably rest on a water surface are well known. Said floatable devices and namely floatable loungers previously disclosed are relatively complex in construction and therefore relatively difficult and expensive to produce, and furthermore are relatively heavy and therefore costly to transport.

U.S. Pat. No. 4,564,240 provides for a lounger or reclining chair comprising a rigid plastic body with a continuous supporting surface. Said rigid plastic body consists of two single-piece half-shells, namely a bottom half-shell and a top half-shell made of moulded plastic which define an air cavity in said rigid plastic body. Said bottom half-shell is moulded with two bulges that increase the size of said air cavity. Said top half-shell is moulded to the shape of the human body and includes widened depressions for the buttocks, and head and arm rests which also act as lateral floats U.S. Pat. No. 4,986,781 discloses a construction for a "Floating Lounge" for use in a swimming pool or the like which comprises a lounge body having a contoured configuration which includes: a back portion; seat portion; buoyant arm rests attached to the sides of said lounge body; enclosed fluid distribution chamber; orifices distributed throughout the top surface of said lounge body; and means for supplying fluid under an elevated pressure to said flow distribution chamber for delivering small jets of fluid under pressure onto a person supported on said lounge body through said orifices to provide a massage-like action. Said lounge body is preferably made of a rigid construction of such materials as acrylic, fibreglass, polyvinyl chloride or polyethylene.

U.S. Pat. No. 5,004,296 teaches a floating chair which includes a rigid S-shaped plastic panel containing holes to decrease the weight of said S-shaped panel; two air-inflated cushions adhesively attached to said S-shaped panel; and U-shaped member extending transversely along the rear surface of said S-shaped panel. Said U-shaped member includes two vertically thickened arm portions.

U.S. Pat. No. 3,984,888 discloses an adjustable floating chair which includes: a seat member comprised of a U-shaped tubular frame made of a material such as aluminum; transverse crossbar, said U-shaped frame and crossbar being covered in interwoven webbing; float structure connected to said seat member; and adjustable pivoting backrest member which is connected to said seat member and said float structure.

Thus a floatable device namely a floatable lounger having excellent buoyancy but of simpler construction that is inexpensive to produce and transport is desirable.

DISCLOSURE OF INVENTION

In accordance with one aspect of the present invention, there is provided a floatable device having a first buoyancy means; second buoyancy means spaced from said first buoyancy means; first and second extending means; and headrest rotatable about said first extending means between a first stored position and second operable position.

In accordance with another aspect of the present invention, there is provided a floatable lounger which comprises a first cylindrical buoyancy means, having a first end and second end; second cylindrical buoyancy means, also having a first end and second end; plurality of elongated attachment members disposed between said first and second cylindrical buoyancy means; headrest connected for rotation about one of said elongated attachment members; and first and second cylindrical elongated members.

In accordance with yet another aspect of the present invention, a first cylindrical buoyancy means, having a first part, first connecting means, and second part; second cylindrical buoyancy means, having a first part, second connecting means, and second part; first end disposed at the extremity of said first part of said first cylindrical buoyancy means, and second end disposed at the extremity of said second part of said first cylindrical buoyancy means; first end disposed at the extremity of said first part of said second cylindrical buoyancy means, and second end disposed at the extremity of said second part of said second cylindrical buoyancy means; plurality of elongated attachment members disposed between said first and second cylindrical buoyancy means and attaching said first and second cylindrical buoyancy means; headrest connected for rotating about one of said elongated attachment members; first cylindrical elongated member extending from the extremity of said first end of said first cylindrical buoyancy means to said first end of said second cylindrical buoyancy means; and second cylindrical elongated member extending from the extremity of said second end of said first cylindrical buoyancy means to said second end of said second cylindrical buoyancy means.

BRIEF DESCRIPTION OF DRAWINGS

A detailed description of the first and second preferred embodiments provided herein below with reference to the following drawings, in which.

DESCRIPTION OF THE INVENTION

Figure 1A:
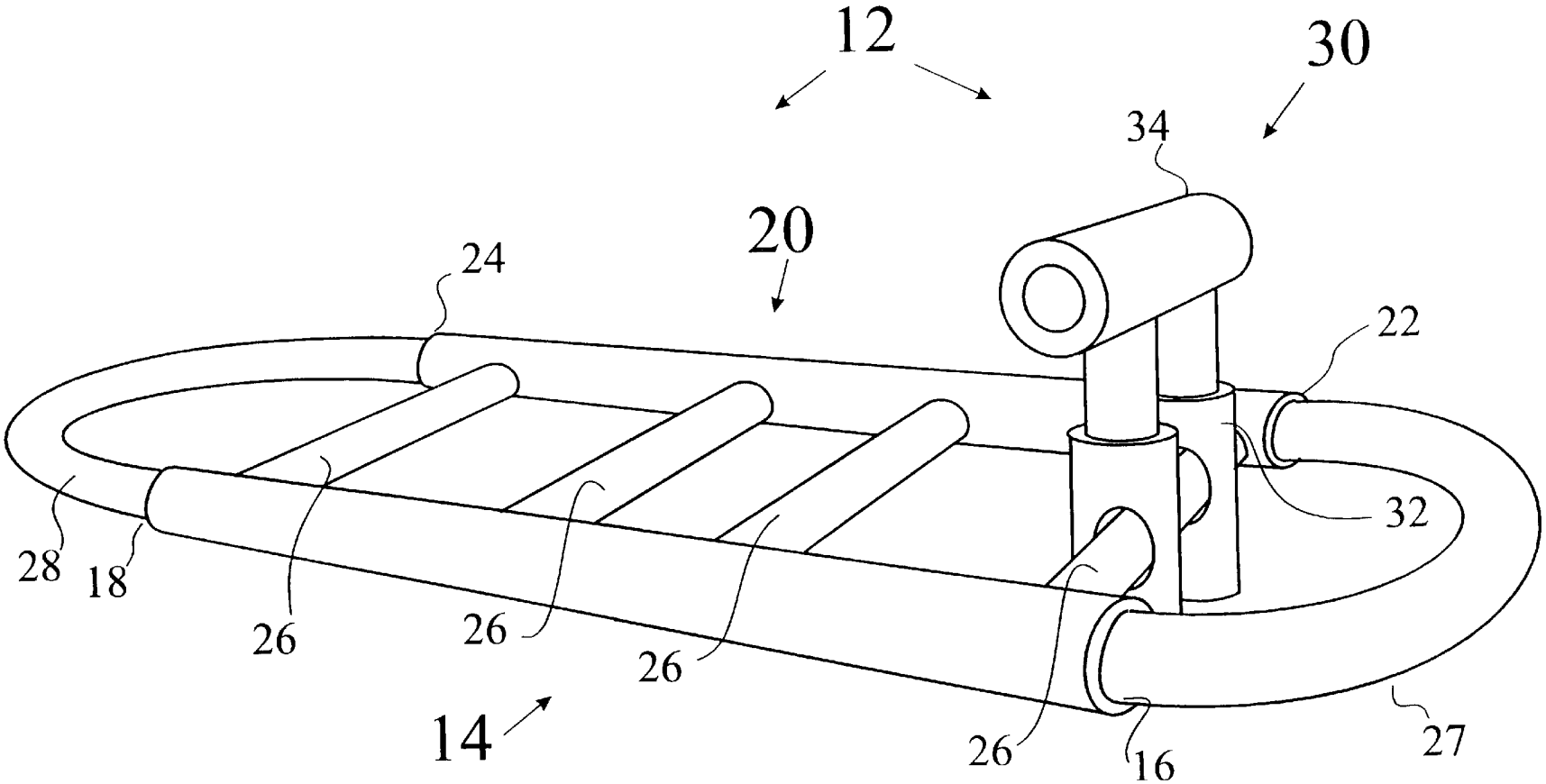
FIG. 1*a*, in a perspective view, illustrates the first preferred embodiment of the floatable lounger wherein the headrest is in the intermediate position.

In the description which follows, like parts are marked throughout the specification and the drawings with the same respective reference numerals. The drawings are not necessarily to scale and in some instances proportions may have been exaggerated in order to more clearly depict certain features of the invention.

Referring to FIG. 1*a*, there is illustrated in a perspective view the first preferred embodiment of the present invention namely a floatable lounger 12 which includes a first cylindrical buoyancy means 14 having a first end 16 and second end 18; second cylindrical buoyancy means 20 spaced from said first buoyancy means 14, said second cylindrical buoyancy means 20 having also having a first end 22 and second end 24; plurality of attachment members 26 disposed between said first cylindrical buoyancy means 14 and second cylindrical buoyancy means 20 and attaching said first cylindrical buoyancy means 14 and second cylindrical buoyancy means 20; first cylindrical elongated member 27 extending from said first end of first cylindrical buoyancy means 16 to said first end of said second cylindrical buoyancy means 22; second cylindrical elongated member 28 extending from said second end of first cylindrical buoyancy means 18 to said second end of second cylindrical buoyancy means 24; headrest 30 connected for rotation about one of said elongated attachment members 26. Although FIG. 1*a* shows first and second cylindrical buoyancy means 14 and 20 respectively such buoyancy means do not have to be cylindrical and may have other cross-sections such as oval, square, or the like so long as they are buoyant.

Figure 1B:
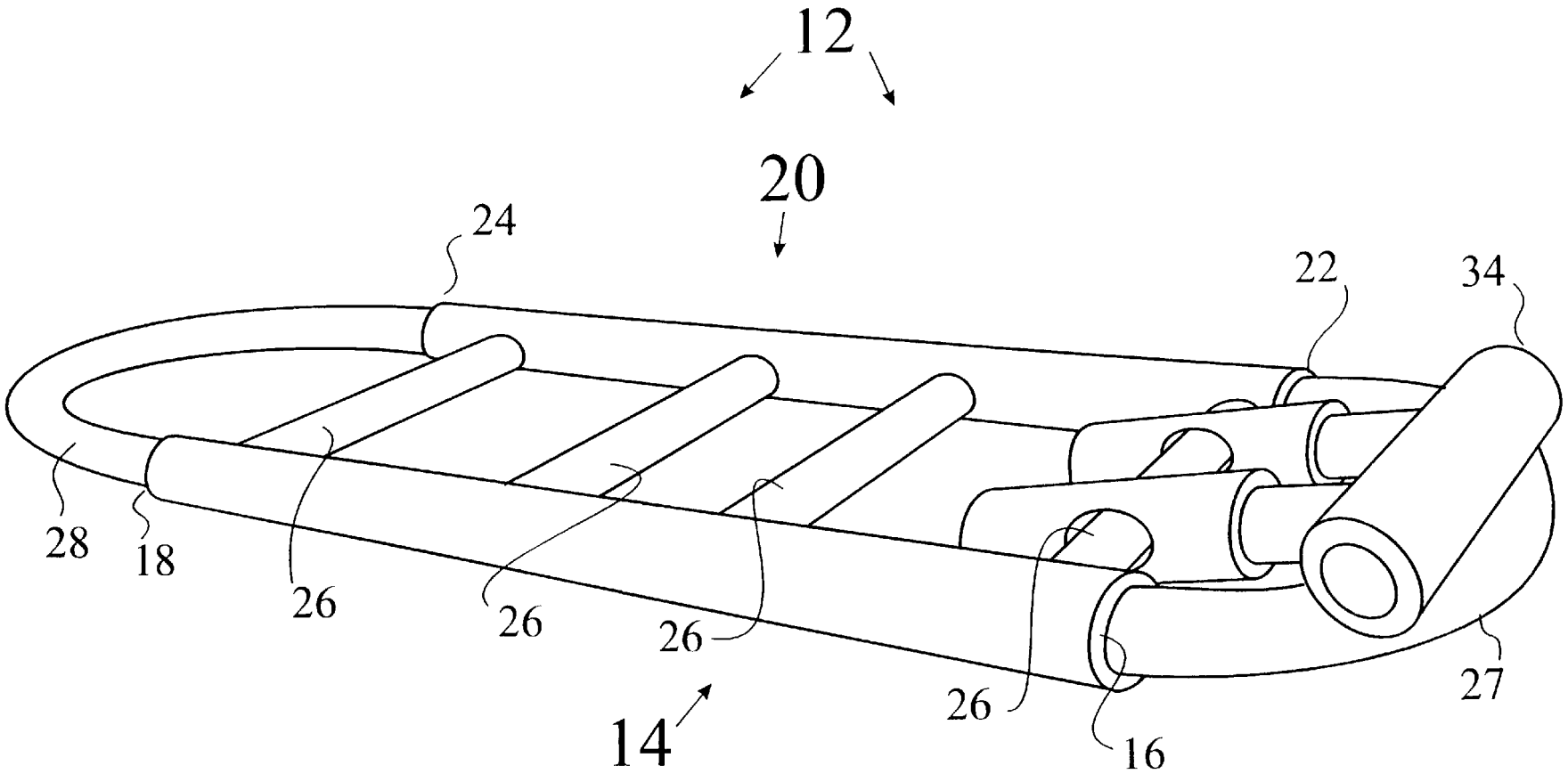
FIG. 1*b*, in a perspective view, illustrates the first preferred embodiment of the floatable lounger wherein the headrest is in the operable position.
Figure 1C:
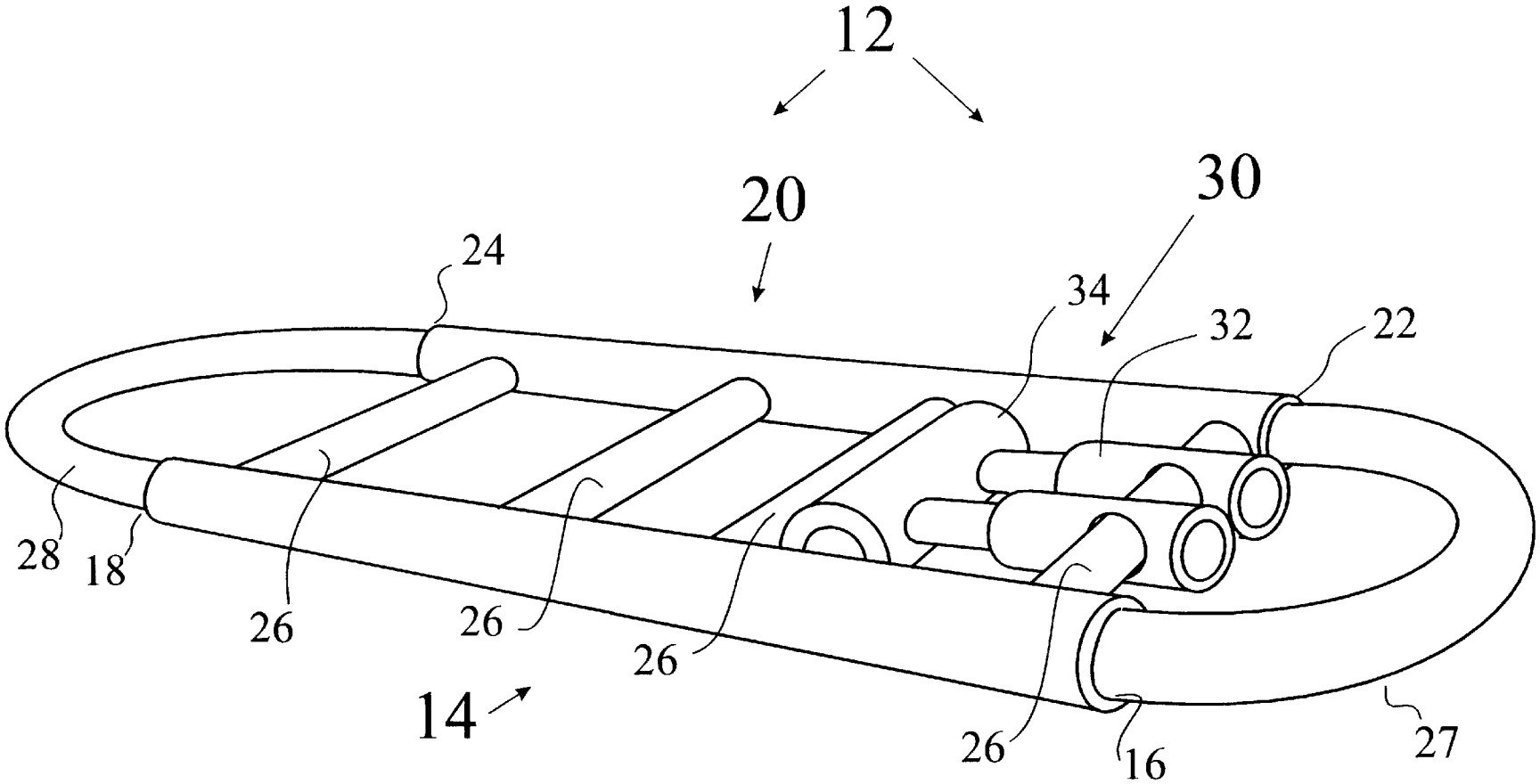
FIG. 1*c*, in a perspective view, illustrates the first preferred embodiment of the floatable lounger wherein the headrest is in the stored position.

Also as illustrated in FIG. 1*a*, the headrest 30 comprises an arm 32 and base 34. The headrest 30 is adaptable to rotate between an operable position and a stored position. As best illustrated in FIG. 1*b*, when the headrest 30 is rotated in the direction of said first cylindrical elongated member 27, the bottom of said base 34 lies on top of said first cylindrical elongated member 27, so that when the floatable lounger 12 is being used by a swimmer, the headrest 30 can be used to enhance the swimmer's comfort by elevating swimmer's head in relation to the rest of the swimmer's body. As demonstrated in FIG. 1*c*, when the headrest 30 is rotated away from said first cylindrical elongated member 27, the headrest 30 can be brought into the stored position, wherein the headrest 30 occupies substantially the same plane as said first cylindrical buoyancy means 14 and second cylindrical buoyancy means 20. The ability to rotate the headrest 30 into the stored position described above contributes to the ease with which said floatable lounger 12 can be stored and transported.

Figure 2:
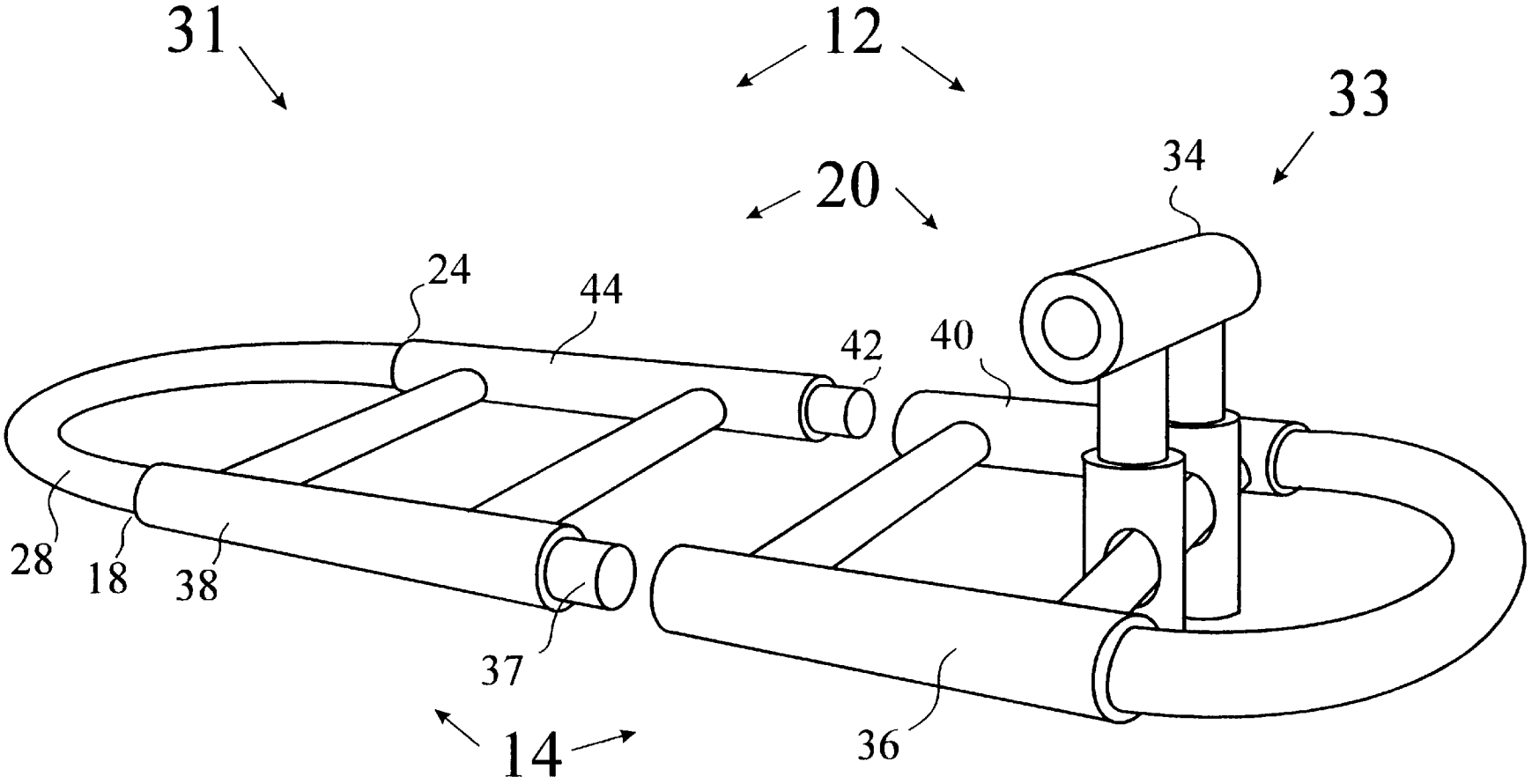
FIG. 2, in perspective view, illustrates the second preferred embodiment of the floatable lounger.

Referring to FIG. 2, there is illustrated the second preferred embodiment of the floatable lounger, namely, an embodiment wherein the floatable lounger can be disassembled into two parts, namely a first segment 31 and second segment 33. In this demountable embodiment of the floatable lounger said first cylindrical buoyancy means 14 has a first part 36, first connecting means 37, and second part 38; said second cylindrical buoyancy means 20 has a first part 40, second connecting means 42, and second part 44.

Figure 3:
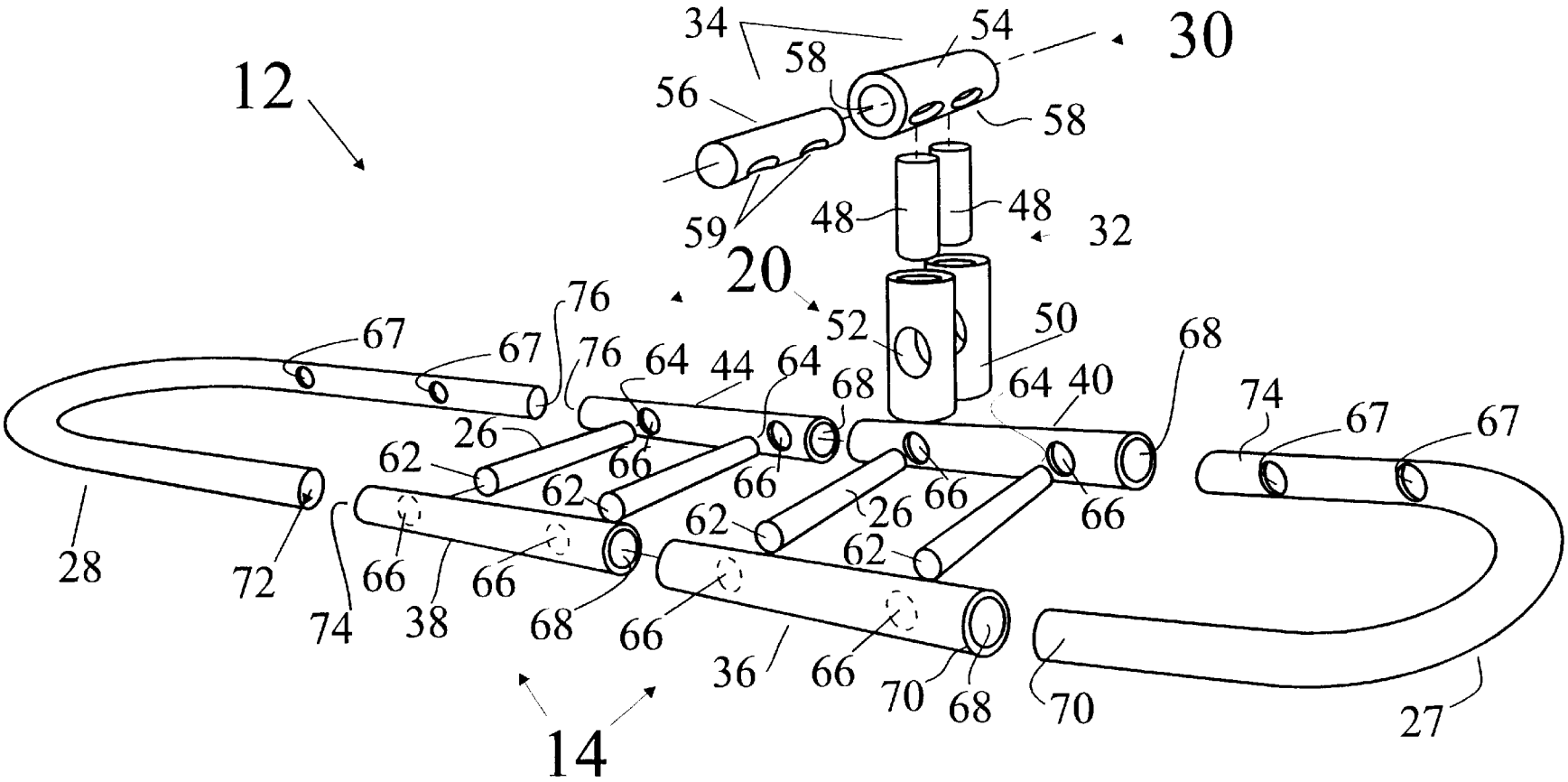
FIG. 3, in an exploded view, illustrates the assembly of the floatable lounger.

Referring now to FIG. 3, there is illustrated in an exploded view, a possible means of assembly of said floatable lounger 12, specifically in this case of the second preferred embodiment of the same. In the headrest 30, the arm 32 consists of a pair of arm cylinders 48, pair of arm tubes 50, and holes 52 disposed in the arm tubes 50. The outer diameter of the pair of arm cylinders 48 is greater than the inner diameter of said arm tubes 50, so that said pair of arm cylinders 48 may be friction fit into the inner diameter of said arm tubes 50 in such a way that holes 52 are unobstructed and therefore can receive one of the plurality of attachment members 26. In other words, holes 52 are adapted to freely receive one of the attachment members 26 to rotate thereabout. Application of a suitable adhesive when friction fitting pair of arm cylinders 48 into arm tubes 50 will ensure that the arm 32 is maintained in an assembled fashion.

The base 34 of the headrest 30 consists of a base tube 54, base cylinder 56 and base connecting holes 58 disposed in said base tube 54 for receiving said arm cylinders 48. The outer diameter of said base cylinder 56 is greater than the inner diameter of said base tube 54, so that said base cylinder 56 can be friction fit into said inner diameter of base tube 54. Application of a suitable adhesive when friction fitting base cylinder 56 into said inner diameter of base tube 54 will ensure that said base 34 is maintained in an assembled fashion.

Said base tube 54 comprises base connecting holes 58. The diameter of said pair of arm cylinders 48 is greater than the diameter of said base connecting holes 58, accordingly said pair of arm cylinders 48 can be friction fit into said base connecting holes 58. Again, application of a suitable adhesive when friction fitting said pair of arm cylinders 48 in said base connecting holes 58 allows the base 34 to be permanently attached to the arm 32.

Furthermore, additional connecting holes 59 can be fashioned in said base cylinder 56 for receiving said pair of arm cylinders 48 which are coaxial or register with said base connecting holes 58. Each of the additional connecting holes 59 also having a smaller diameter than the pair of arm cylinders 48 so as to frictionally receive said arm cylinders 48. A suitable adhesive can be used when friction fitting said pair of arm cylinders 48 into said additional connecting holes 59 to further solidify the assembly of the headrest 30.

As shown in FIG. 3, each of the attachment members 26 has a first extremity 62 and second extremity 64. Each of said first part 36 and second part 38 of said first cylindrical buoyancy means 14 and said first part 40 and second part 44 of said second cylindrical buoyancy means 20 has locating holes 66 to receive said first extremity 62 and second extremity 64 of the attachment members 26; and an inner diameter 68 for receiving said first cylindrical elongated member 27 and second cylindrical elongated member 28. The outer diameter of said first cylindrical elongated member 27 and second cylindrical elongated member 28 is greater than said inner diameter 68 of said first and second cylindrical buoyancy means. Accordingly, said first cylindrical elongated member 27 and second cylindrical elongated member 28 can be friction fit into said inner diameter 68 of said first cylindrical buoyancy means and second cylindrical buoyancy means.

Figure 4:
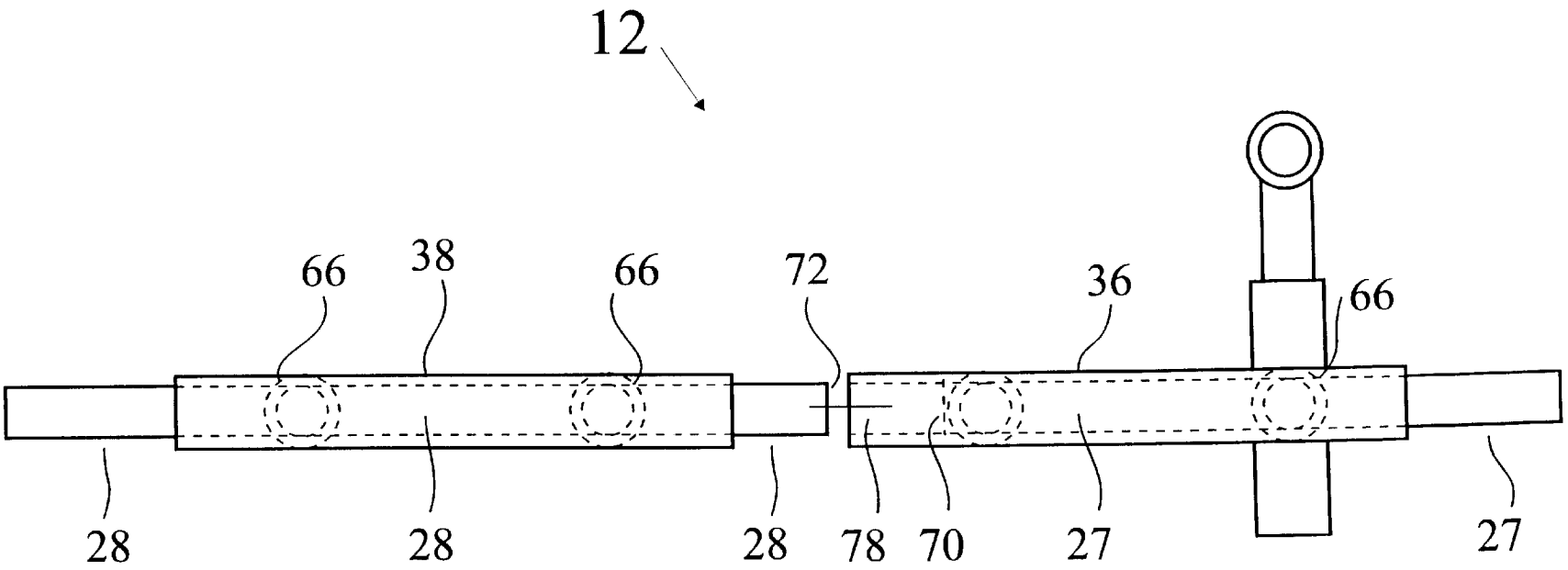
FIG. 4, in a cross-sectional view from the side of the floatable lounger, illustrates the assembly of the present invention.

Each of said first of said first cylindrical elongated member 27 and second cylindrical elongated member 28 has a first end 70 and 72 respectively, and a second end 74 and 76 respectively. As best illustrated by FIG. 4, which is a cross-sectional view from the side of said floatable lounger 12, said first end 70 and second end 74 of said first cylindrical elongated member are friction fitted into said inner diameter 68 of said first part 36 of said first cylindrical buoyancy means and said first part 40 of said second cylindrical buoyancy means, so as to define locating cavity 78. Similarly, said first end 72 and second end 76 of said second cylindrical elongated member 28, are friction fitted into said inner diameter 68 of said second part of first buoyancy means 38 and said second part of second cylindrical buoyancy means 44 so as to define a connecting means 79. Because the outer diameter of said connecting means 79 is greater than the inner diameter of said locating cavity 78, said connecting means 79 can be friction fitted into said locating cavity 78, so as to allow assembly and disassembly of said first part 31 and second part 33 of the floatable lounger.

The diameter of said attachment members 26 is greater than said inner diameter 68 of each of said first part 36 and second part 38 of said first cylindrical buoyancy means and each of said first part 40 and second part 44 of said second cylindrical buoyancy means, accordingly, said attachment members 26 can be friction fitted into said locating holes 66. Furthermore, additional locating holes can be fashioned in said first cylindrical elongated member 27 and second cylindrical elongated member 28 that communicate with each of said locating holes 66 and which also having a smaller diameter than the said diameter of said attachment members 26 and thus frictionally receive said attachment members 26. A suitable adhesive can be used when friction fitting said attachment members 26 in said locating holes 66 and said corresponding additional locating holes disposed in said first and second cylindrical elongated members to maintain the floatable lounger in an assembled state.

In the construction of the floatable lounger described above, the friction fitting of said first and second cylindrical elongated members into said first and second cylindrical buoyancy means increases the buoyancy of said floatable lounger along said first and second cylindrical buoyancy means, which increased buoyancy will assist the swimmer to float in the water, by distributing the swimmer's weight along the length of the floatable lounger.

Said attachment members 26 are spaced so that two of such attachment members 26 are proximate enough to support the middle portion of a swimmer.

All of the components of floatable lounger 12 described above can be made from a variety of materials which are generally buoyant such as polyethylene foam or the like. Such components made specifically of polyethylene foam can be formed using extruders that are well-known in the art that generally comprise a hopper through which an extrudable material is introduced into the extruder; a heating element to melt the extrudable material if such material is a thermoplastic; and an aperture or die through which the extrudable material is introduced.

The floatable lounger is also adaptable to receive a number of various shaped containers which may be made, for example, of plastic such as cup-holders, beer-holders, audio device holders and the like. Said containers can be fixed to the outside of either of first cylindrical buoyancy means 14 or second cylindrical buoyancy means 20 by means of a suitable securing means such as a nut and bolt that is traversed through the first cylindrical buoyancy means 14 or second cylindrical buoyancy means 20.

The illustrated floatable lounger is designed primarily for use in the water, however, the present invention can also be used to support a person in a reclined position on a land surface.

Various embodiments of the invention have now been described in detail. Since changes in and/or additions to the above-described best mode may be made without departing from the nature, spirit or scope of the invention, the invention is not to be limited to said details. Specifically, the invention described herein could be achieved by using a construction wherein said first cylindrical buoyancy means and second cylindrical buoyancy means, as described above, are attached to an additional buoyancy means having a substantially circular shape, which additional buoyancy means encircles said first cylindrical buoyancy means and second cylindrical buoyancy means, and which additional buoyancy means supports said headrest, also as described above. Alternatively, although the invention has been described with the outer diameter of a tube being larger than the inner diameter of a hole adapted to receive the tube for a friction fit, it is possible to obtain the benefits of the invention described herein by having the outer diameter of the tube being the same as or slightly less than the inner diameter of a hole adapted to receive the tube and using an adhesive to connect the same. However, in this alternative mode it is preferable that the diameter of connecting means 79 be larger than the inner diameter of the locating cavity 78 so that the first part 36 can be separated from the second part 38 for easy storage and transportation. However, it is also possible that the outer diameter of the connecting means 79 be the same as or slightly less than the inner diameter of the locating cavity 78 with an adhesive being applied.

I claim:

1. A floatable device having:

(a) a first buoyancy means;

(b) second buoyancy means spaced from said first buoyancy means, and wherein said second buoyancy means is disposed in substantially the same plane as said first buoyancy means;

(c) first and second extending means extending between said first and second buoyancy means; and (d) headrest rotatable about said first extending means between:

(i) a fist stored position wherein said headrest is disposed in substantially the same plane as said first and second buoyancy means, and (ii) second operable position wherein said headrest rests against said second extending means.

2. A floatable device as claimed in claim 1 wherein said first extending means comprises a plurality of elongated attachment members disposed between said first and second buoyancy means.

3. A floatable device as claimed in claim 2 wherein said second extending means comprises an elongated member extending from each end of said buoyancy means.

4. A floatable lounger which comprises:

(a) a first cylindrical buoyancy means, having a first end and second end;

(b) second cylindrical buoyancy means, having a first end and second end;

(c) plurality of elongated attachment members disposed between said first and second cylindrical buoyancy means and attaching said first and second cylindrical buoyancy means;

(d) headrest connected for rotation about one of said elongated attachment members;

(e) first curved elongated member extending from said first end of said first cylindrical buoyancy means to said first end of said second cylindrical buoyancy means; and (f) second curved elongated member extending from said second end of said first cylindrical buoyancy means to said second end of said second cylindrical buoyancy means.

5. A floatable lounger as claimed in claim 4 wherein each of said elongated attachment members has a first extremity, second extremity and outer diameter, and wherein said first and second cylindrical buoyancy means have an outer diameter greater than said outer diameter of said elongated attachment members.

6. A floatable lounger as claimed in claim 5 wherein said first and second buoyancy means have a plurality of attachment means comprising connecting holes which frictionally engage said first and second extremity of each of said elongated attachment members.

7. A floatable lounger as claimed in claim 5 wherein said first and second curved elongated members each have a first end, second end, and outer diameter, and wherein said outer diameter of said first and second curved elongated members is smaller than said outer diameter of said first and second cylindrical buoyancy means.

8. A floatable lounger as claimed in claim 7 wherein said first and second end of each of said first and second cylindrical buoyancy means each have an end attachment means which comprises connecting apertures which frictionally engage said first and second end of each of said first and second curved elongated members.

9. A floatable lounger as claimed in claim 4 wherein said headrest comprises an arm and base, wherein said arm rotates around one of the said plurality of elongated attachment members and said base is connected to said arm.

10. A floatable lounger, as claimed in claim 9 wherein said headrest has a stored position in which said base and arm occupy substantially the same plane as said first and second cylindrical buoyancy means, and an operable position in which said base rests against said first curved elongated member.

11. A floatable lounger as claimed in claim 4 wherein said first cylindrical buoyancy means, second cylindrical buoyancy means, plurality of elongated attachment members, headrest, first curved elongated member, and second curved elongated member comprise soft resilient buoyant material.

12. A floatable lounger which comprises:

(a) a first cylindrical buoyancy means, having a first part, first connecting means, and second part;

(b) second cylindrical buoyancy means, having a first part, second connecting means, and second part; and wherein said second buoyancy means is disposed in substantially the same plane as said first buoyancy means;

(c) first end disposed at the extremity of said first part of said first cylindrical buoyancy means, and second end disposed at the extremity of said second part of said first cylindrical buoyancy means;

(d) first end disposed at the extremity of said first part of said second cylindrical buoyancy means, and second end disposed at the extremity of said second part of said second cylindrical buoyancy means;

(e) plurality of elongated attachment members disposed between said first and second cylindrical buoyancy means and attaching said first and second cylindrical buoyancy means;

(f) headrest connected for rotating about one of said elongated attachment members;

(g) first curved elongated member extending from the extremity of said first end of said first cylindrical buoyancy means to said first end of said second cylindrical buoyancy means; and (h) second curved elongated member extending from the extremity of said second end of said first cylindrical buoyancy means to said second end of said second cylindrical buoyancy means.

13. A floatable lounger as claimed in claim 12 wherein each of said elongated attachment members has a first extremity, second extremity and outer diameter, and wherein said first and second cylindrical buoyancy means have an outer diameter greater than said outer diameter of said elongated attachment members.

14. A floatable lounger as claimed in claim 13 wherein said first and second buoyancy means have a plurality of attachment means comprising connecting holes which frictionally engage said first and second extremity of each of said elongated attachment members.

15. A floatable lounger as claimed in claim 13 wherein said first and second curved elongated members each have a first end, second end, and outer diameter, and wherein said outer diameter of said first and second curved elongated members is smaller than said outer diameter of said first and second cylindrical buoyancy means.

16. A floatable lounger as claimed in claim 15 wherein said first and second end of each of said first and second cylindrical buoyancy means each have an attachment means which comprises connecting apertures which frictionally engage said first and second end of said of said first and second curved elongated members.

17. A floatable lounger as claimed in claim 16 wherein said headrest comprises an arm and base, wherein said arm revolves around one of the said plurality of elongated attachment members and said base is connected to said arm.

18. A floatable lounger, as claimed in claim 17 wherein said headrest has a first stored position in which said base and arm occupy substantially the same plane as said first and second cylindrical buoyancy means, and an operable position in which said base rests against said first curved elongated member.

19. A floatable lounger, as claimed in claim 12 wherein said first connecting means of said first buoyancy means and second connecting means of said second buoyancy connecting means consist of a connecting member attached to said first pan of each of said first and second cylindrical buoyancy means, said connecting member having an outer diameter hat is smaller than said outer diameter of said first and second cylindrical buoyancy means, which connecting member frictionally engages an orifice disposed in said second part of each of said first and second cylindrical buoyancy means.

20. A floatable lounger as claimed in claim 12 wherein said first cylindrical buoyancy means, second cylindrical buoyancy means, plurality of elongated attachment members, headrest and first curved elongated member and second curved elongated member comprises polyethylene foam.

* * * * *